United States Patent [19]

Caillé

[11] Patent Number: 4,483,443

[45] Date of Patent: Nov. 20, 1984

[54] PACKAGING BOX FOR A CHEESE

[75] Inventor: Michel Caillé, Sainte-Solange, France

[73] Assignee: Laiteries Hubert Triballat, France

[21] Appl. No.: 433,990

[22] Filed: Oct. 12, 1982

[51] Int. Cl.[3] ..... B65D 1/34; B65D 6/04

[52] U.S. Cl. ..... 206/459; 206/564; 220/200; 220/306; 220/352

[58] Field of Search ..... 206/557, 564, 459; 220/200, 306, 352

[56] References Cited

U.S. PATENT DOCUMENTS

| | | | |
|---|---|---|---|
| D. 158,253 | 4/1950 | Gantz | 206/564 |
| D. 165,219 | 11/1951 | Degner | 206/557 |
| 2,069,957 | 2/1937 | Klein | 206/557 |
| 2,299,610 | 10/1942 | Clark | 206/557 |
| 2,469,530 | 5/1949 | Thompson | 206/557 |
| 3,730,338 | 5/1973 | Chesky | 206/557 |
| 3,850,296 | 11/1974 | Hirata et al. | 206/564 |

*Primary Examiner*—Joseph Man-Fu Moy

*Attorney, Agent, or Firm*—Parkhurst & Oliff

[57] ABSTRACT

Packaging box for a cheese, comprising a base with an upper surface, a lateral rib and transverse ribs on the upper surface which define a recess, and a tray located in the recess and having a length and a width which are less than those of the recess, the thickness of the tray being greater than the depth of the recess.

2 Claims, 2 Drawing Figures

PACKAGING BOX FOR A CHEESE

The present invention relates to a box in which a cheese may be packaged and marketed, and the invention relates in particular to a box for a cheese with whey which should be cut into slices.

A box for a cheese according to the invention has a number of requirements. It should afford protection to the cheese against contamination by dirt and against damage by knocks in transit. It should provide for confinement or collection of the soft or fluid part of the cheese. The cheese itself should be presented to the consumer properly held with nothing to inhibit easy cutting of the cheese and so that it may be presented whether cut or uncut.

Accordingly this invention provides a box for a cheese consisting of a base having on its upper surface lateral and transverse ribs which bound and define a recess in which is located, for mounting the cheese, a tray which has a length and width less than those of the recess but a thickness is greater than the depth of the recess.

The recess in the base facilitates the collection of the soft fluid part of the cheese which may run into the interstices between the tray and the ribs defining the recess. However the upper surface of the tray is located above at least the lateral ribs so that these do not inhibit movement of a cutting tool in slicing a cheese mounted on the tray. Moreover, in order to facilitate cutting of the cheese, it may rest against an end stop which may be constituted by one of the transverse ribs being formed to upstand above the other ribs.

This upstanding rib may be surmounted by a label holder for the cheese, or its upper part may be slotted to receive a label. This avoids any need to stamp, prick or mark the cheese, which may be contrary to the requirements of hygiene and regulation.

The box is completed by a flanged cover which interfits with the base, having lateral flanges the lower edges of which present projecting castellations which engage with indented crenellations at the lateral edges of the base. In this way the means which provide interfitting between the cover and the base do not impede cutting or slicing of the cheese since the crenellations at the edges of the base are at a level lower than that of the upper surface of the tray upon which the cheese is intended to rest.

Advantageously the three elements of the box, that is the base, the tray and the cover are formed of polystyrene; it may be of closed cell polystyrene foam material. The cheese adapted to rest on the tray may be wrapped or covered by a sheet of polyethylene film.

By way of example, one embodiment of a box in which a cheese may be packaged and marketed, is illustrated in the accompanying drawings in which.

Figure 1:
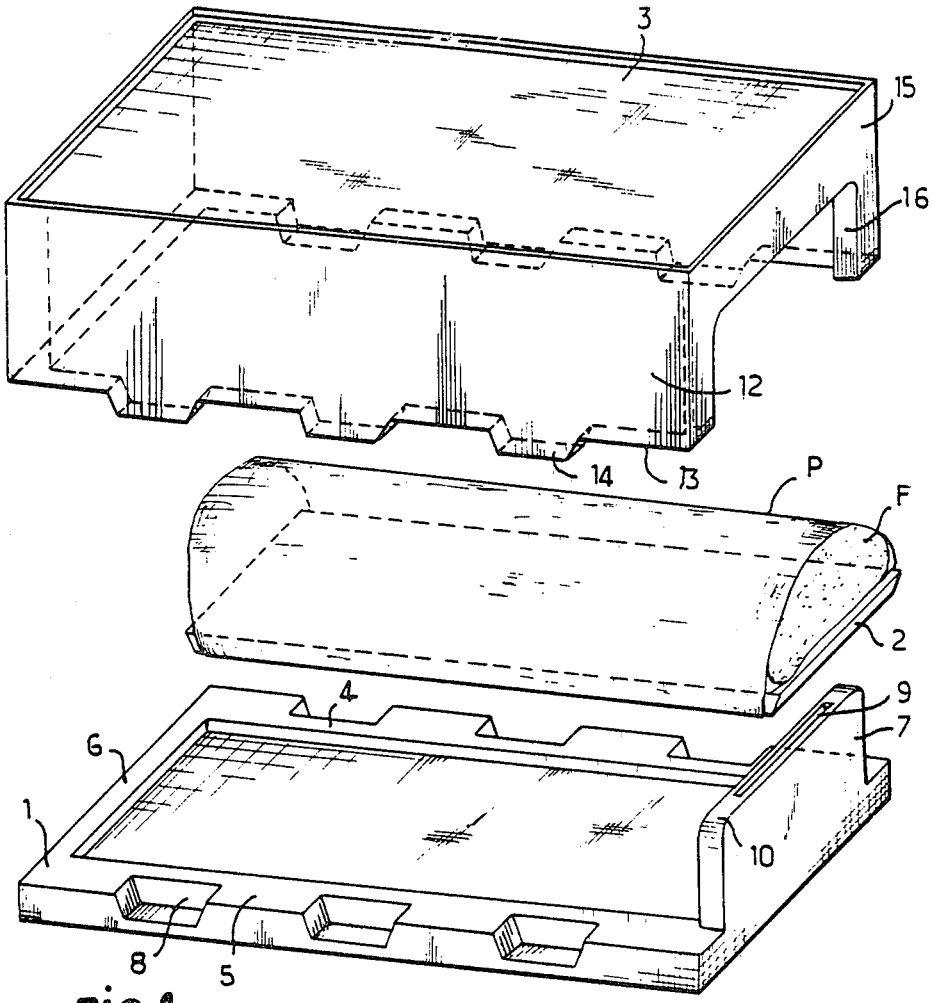
FIG. 1 is an exploded perspective view.
Figure 2:
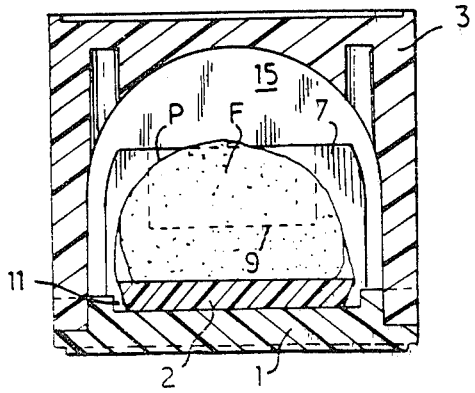
FIG. 2 is a transverse cross-section.

According to the embodiment of the invention illustrated, the box is composed essentially of three parts: a base 1, a tray 2, and a cover 3. The cheese F is mounted on the tray 2 and the cheese F may be covered or wrapped in a film P of polyethylene. The base 1, the tray 2 and the cover 3 are preferably formed from polystyrene.

The base 1 is generally rectangular. On its upper face, lateral ribs 4 and 5, a transverse rib 6 and a transverse rib 7 upstand to bound and define a recess which is also generally rectangular.

Three indented crenellations 8 are located at the lateral edges of the base 1 in each of the ribs 4 and 5.

A slot 9 is formed on a flat upper surface 10 of the rib 7 which is raised to upstand beyond the other ribs 4, 5 and 6. The slot 9 is adapted to receive a label.

The tray 2 is adapted to fit into the recess defined by the ribs 4, 5 and 6. The length and breadth of the tray 2 are less than those of the recess. The thickness of the tray 2 is greater than the depth of the recess. The tray therefore is an easy fit in the recess and forms with the ribs 4, 5 and 6 interstices 11. Into these can run the whey of a cheese F mounted upon the tray 2. The size of the interstices is increased towards their bottoms since the tray 2 is trapezoidal in cross-section with its smaller face turned towards the bottom of the recess. The upper face of the tray is generally rectangular.

The cover 3 has lateral flanges 12 at the lower edges of which are three projecting castellations 14 for interengagement with the crenellations 8 of the base 1. The cover 3 has one end flange 15 indented at 16 to receive the upstanding rib 7 constituting an end stop for a cheese resting on the tray 2.

For the consumer to be presented with the cheese F, it suffices to remove the cover 3. The cheese may be pre-cut or it may be presented ready for cutting and there will have been no leak of whey. Cutting is facilitated and unimpeded in that the upper surface of the tray 2 is located above the upper levels of the ribs 4, 5 and 6, and the cheese is properly located for cutting by resting against the end stop constituted by the raised rib 7.

I claim:

1. A packaging box for a cheese comprising:

a base with an upper surface, a lateral rib and transverse ribs which define a recess;

a tray located in said recess, having a length and a width which are less than those of the recess, and having a height greater than the depth of the recess;

a transverse rib projecting upwardly substantially above said other transverse and lateral ribs so as to form an end stop for a cheese resting on said tray;

said upper surface of said tray projecting above said ribs of said base except for the transverse rib forming said end stop;

a label holder disposed on the transverse rib constituting an end stop;

said label holder comprising a slit in the transverse rib forming said end stop;

a cover adapted to interfit with said base; and said cover having lateral flanges, and the bottom of said flanges having integrally formed projecting castellations which engage with indented crenellations formed at a lateral border of said base.

2. The package box for a cheese according to claim 1, wherein said base, said tray, and said cover are formed from closed-cell polystyrene foam material.

* * * * *